United States Patent [19]

Ainoya et al.

[11] 4,443,091

[45] Apr. 17, 1984

[54] YOKE MECHANISM OF ELECTROPHOTOGRAPHIC PRINTING APPARATUS

[75] Inventors: Masayuki Ainoya; Hiroomi Kozawa; Takao Chikuzenya, all of Ibaraki, Japan

[73] Assignee: Hitachi Koki Co., Ltd., Tokyo, Japan

[21] Appl. No.: 390,431

[22] Filed: Jun. 21, 1982

[51] Int. Cl.[3] ..... G03G 15/16

[52] U.S. Cl. ..... 355/3 TR

[58] Field of Search ..... 355/3 TR, 14 SH, 3 SH; 226/74, 75, 78, 170, 171, 172, 173

[56] References Cited

U.S. PATENT DOCUMENTS

| | | | |
|---|---|---|---|
| 3,997,043 | 12/1976 | Aizawa et al. | 226/74 |
| 4,010,882 | 3/1977 | Turner | 226/75 |
| 4,257,700 | 3/1981 | Tsuda et al. | 355/3 TR |

*Primary Examiner*—R. L. Moses
*Assistant Examiner*—D. S. Warren
*Attorney, Agent, or Firm*—Sughrue, Mion, Zinn, Macpeak & Seas

[57] ABSTRACT

A yoke mechanism for a copier is provided with an engagement mechanism capable of holding the yoke at a position intermediate the retracted and transfer positions, at which position the yoke may be easily loaded with paper, and then moved to the transfer position, in one simple operation.

6 Claims, 5 Drawing Figures

YOKE MECHANISM OF ELECTROPHOTOGRAPHIC PRINTING APPARATUS

BACKGROUND OF THE INVENTION

This invention relates to a yoke mechanism for a printing apparatus using an electrophotographic method.

In order to reduce the cost of a yoke mechanism and reduce the mechanism to compact size, a double face tractor in which both sides of the tractor are used, as illustrated in FIGS. 1 and 2, is in general use. An electrophotographic printing apparatus 1 comprises a corona charger 3 for applying a charge to a photoconductor 2, an optical portion 4 for writing information on the photoconductor 2, a developing device 5, a yoke mechanism 7 for feeding printing paper 6 at a uniform speed and transferring an image on the photoconductor 2 onto the printing paper 6, a fixing device 8 for heat fixing the transferred image, and a stacker 9 for folding the printing paper after fixing.

A double face type (using both sides) tractor 10 for feeding the printing paper 6, a retractor 11 for bringing the paper into contact with and separating it from the photoconductor 2 at time of transfer, and a transfer charger 12 are disposed in the interior of the yoke mechanism 7. Paper presses 10*a*, 10*b* are freely pivotally supported on both sides of the tractor 10, respectively. One end of the yoke mechanism 7 is pivotally supported on a frame 13 by a hinge 7*a* in such a manner that when the yoke mechanism 7 is opened, the rear thereof is adapted to abut a stopper 13*a* projecting backwardly from the frame 13 to be stopped.

This position of the yoke mechanism is called the retract position. When the yoke mechanism 7 is closed, the forward end thereof is adapted to abut a pin 14 mounted on the front of the frame 13 to stop the yoke mechanism. This position of the yoke mechanism is called the transfer position, where the retractor 11 approaches the photoconductor surface 2 in such a manner as to perform a transfer step.

Conventionally, when loading such a yoke mechanism with printing paper, as shown in FIG. 2, the paper presses 10*a*, 10*b* on both sides of the tractor 10 are opened to place the paper 6 therein with the yoke mechanism 7 fixed perpendicularly. This method is very complicated to perform because the paper 6 is inserted from laterally of the tractor 10.

In another method, the paper 6 is placed on the side of the paper press 10*a* of the tractor 10 at the retracted position, and is then placed on the side of the press 10*b* of the tractor 10 with the yoke mechanism 7 closed. This is easy because the paper is placed in a substantially horizontal state. But when the yoke mechanism 7 is closed while the paper is fixed on only one side of the tractor 10, the slack paper 6 can directly contact the soft surface of the photoconductor 2, which sometimes causes the photoconductor 2 to be damaged. Accordingly, the expensive photoconductor 2 becomes unusable.

SUMMARY OF THE INVENTION

It is an object of this invention to overcome the above described disadvantages of the prior art, and to facilitate the paper loading operation in the yoke mechanism.

This invention is characterized by the fact that a yoke engagement mechanism, which is adapted to temporarily stop the yoke mechanism at a preparatory position where the paper is easily loaded before the yoke mechanism is completely closed, is disposed between the yoke mechanism and the frame.

DETAILED DESCRIPTION OF THE PREFERRED EMBODIMENTS

Figure 1:
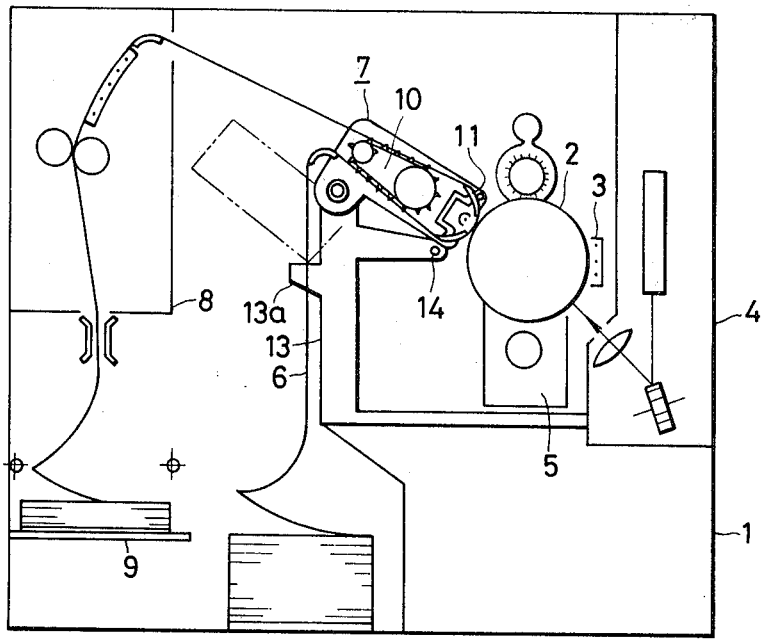
FIG. 1 illustrates a typical electrophotographic printing apparatus.
Figure 2:
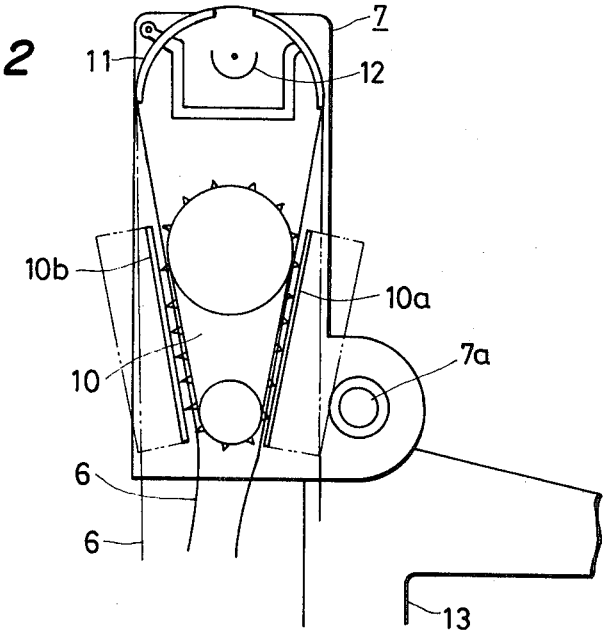
FIG. 2 is a side view showing a conventional yoke mechanism.
Figure 3:
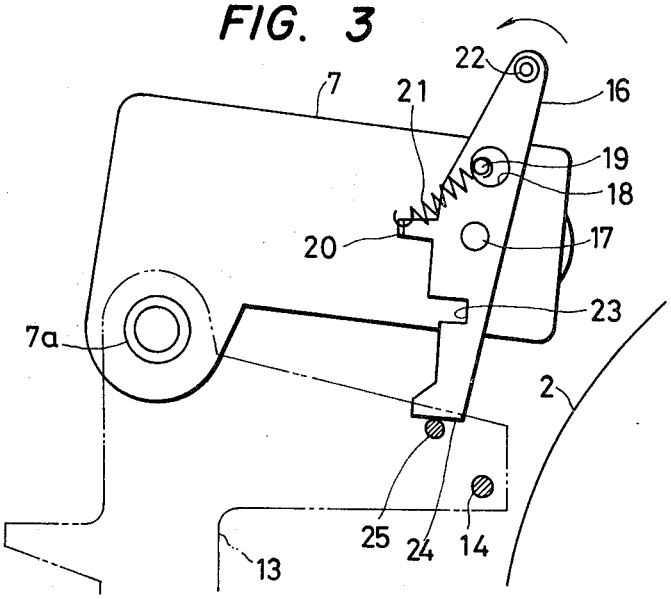
FIG. 3 is a side view showing one embodiment of a yoke mechanism according to the present invention.
Figure 4:
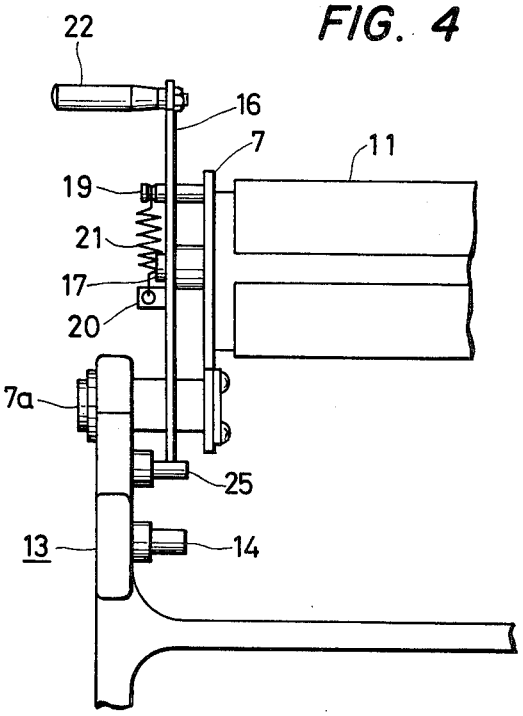
FIG. 4 is a front view of the apparatus of FIG. 3.
Figure 5:
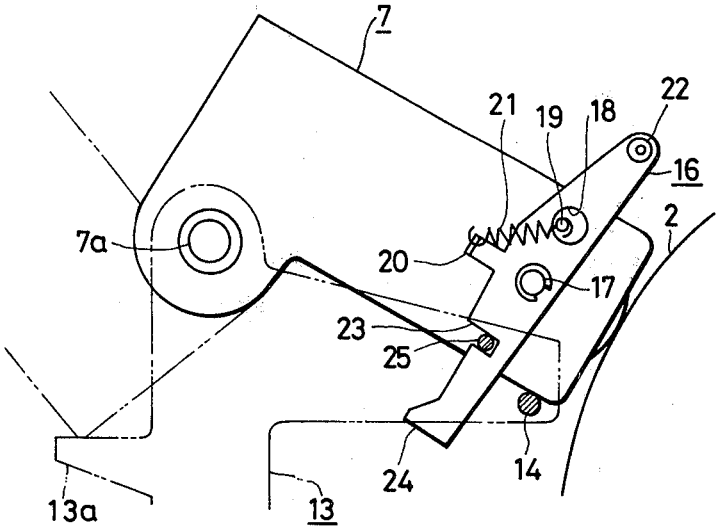
FIG. 5 is a side view showing the yoke mechanism of the present invention located at the transfer position.

This invention will now be described by way of one embodiment thereof, wherein, as seen in FIGS. 3 to 5, a clamp lever 16 is freely pivotally supported on the side of the forward end of the yoke mechanism 7 by a pin 17. The clamp lever 16 is provided with a hole 18 above the support point thereof, in which a pin 19 mounted on the yoke mechanism 7 is loosely fitted, so that the range of movement of the clamp lever 16 is regulated by the interval between the hole 18 and the pin 19. A projection 20 is mounted on the central portion of the clamp lever 16, and a tension spring 21 is extended between the projection 20 and the pin 19 in such a manner as to always urge the clamp lever 16 clockwise, so that the clamp lever 16 is retained with the inner periphery of the hole 18 abutting the pin 19.

A handle 22 for operation is formed on the upper portion of the clamp lever 16, the lower portion of the lever being provided with a groove 23 opened laterally, and the bottom portion thereof being provided with an abutting surface 24. A stopper pin 25 is disposed on the front of the frame 13 in such a manner as to engage the abutting surface 24 of the clamp lever 16. When the yoke mechanism 7 is closed, the abutting surface 24 is adapted to engage the stopper pin 25, so that in such a condition, the forward end of the yoke mechanism 7 is stopped at a preparatory position slightly spaced from the photoconductor 2.

For paper loading, the yoke mechanism 7 is first opened to the retract position, and the paper press 10*a* mounted on the rear face of the tractor 10 is opened to place the printing paper 6 therein, and then closed. Secondly, the yoke mechanism 7 is closed and set to the preparatory position, the paper press 10*b* mounted on the front face of the tractor 10 being opened to place the printing paper 6 therein.

After that, when the clamp lever 16 is moved in the direction of the arrow by means of the handle 22, the surface 24 located at the lower end of the clamp lever 16 is released from the stopper pin 25, and the yoke mechanism 7 is further moved to stop at the transfer position. At this time the yoke mechanism 7 is adapted to engage the pin 14, with the clamp lever 16 engaging the stopper pin 25 by means of the groove 23, so that the yoke mechanism 7 is fixed at the transfer position.

It will be apparent that this invention, as described above, can provide a yoke mechanism having a double faced tractor, which is pivotally supported in such a manner as to freely move between a transfer position and a retracted position, which can ease the loading of the yoke mechanism with printing paper, by providing an engagement mechanism for stopping the yoke mechanism at a preparatory position between the retracted and transfer positions. The device can thus completely eliminate the danger of damaging the photoconductor, as the yoke mechanism is moved to the transfer position with the printing paper completely set thereon, so as to improve the reliability of the apparatus.

What is claimed is:

1. A yoke mechanism for an electrophotographic printing apparatus, comprising:

yoke means including a tractor, said yoke means being pivotably mounted on a frame for movement between a retracted position and a transfer position, and engagement means for stopping said yoke means at an intermediate position between said retracted and transfer positions to facilitate the loading of printing paper onto said yoke means.

2. A yoke mechanism for an electrophotographic printing apparatus as claimed in claim 1, wherein said engagement mechanism comprises a lever member pivotally supported on a main body of said yoke mechanism, said lever member being adapted to abut said frame.

3. A yoke mechanism for an electrophotographic printing apparatus as claimed in claim 2, said lever member having a contact surface for abutting a portion of said frame, and being movable to disengage said contact surface from said frame portion.

4. A yoke mechanism for an electrophotographic printing apparatus as claimed in claims 2 or 3, said lever member being pivotable within a predetermined angular range.

5. A yoke mechanism for an electrophotographic printing apparatus as claimed in claims 1, 2 or 3, said lever member being biased towards a first position, and being movable against the biasing force, and including means for locking said lever member to said frame.

6. A yoke mechanism for an electrophotographic printing apparatus as claimed in claim 3, said lever member further including means for locking said lever member to said portion of said frame in said transfer position.

* * * * *